US009039640B2

(12) United States Patent
Crowell et al.

(10) Patent No.: US 9,039,640 B2
(45) Date of Patent: May 26, 2015

(54) PORTABLE ROLLER MASSAGER

(75) Inventors: Jason Crowell, Akron, OH (US); April Bertram, Canton, OH (US)

(73) Assignee: Hygenic Intangible Property Holding Company, Akron, OH (US)

( * ) Notice: Subject to any disclaimer, the term of this patent is extended or adjusted under 35 U.S.C. 154(b) by 766 days.

(21) Appl. No.: 13/274,438

(22) Filed: Oct. 17, 2011

(65) Prior Publication Data

US 2013/0096472 A1 Apr. 18, 2013

(51) Int. Cl.
*A61H 15/00* (2006.01)

(52) U.S. Cl.
CPC .... *A61H 15/0092* (2013.01); *A61H 2015/0014* (2013.01); *A61H 2201/0157* (2013.01); *A61H 2201/1692* (2013.01); *A61H 2201/1695* (2013.01)

(58) Field of Classification Search
CPC . A61H 15/00; A61H 15/0085; A61H 15/009; A61H 2015/00; A61H 2015/0007; A61H 2015/0014; A61H 2015/0021; A61H 2015/0042; A61H 2201/0157; A61H 2201/1692; A61H 2201/1695
USPC ..... 601/23, 27, 32, 112, 113, 118, 119, 601/120, 121, 122, 123, 125, 128, 129, 131, 601/134, 135, 136, 137
See application file for complete search history.

(56) References Cited

U.S. PATENT DOCUMENTS

| | | | | |
|---|---|---|---|---|
| 1,882,490 | A * | 10/1932 | Falck | 601/120 |
| 4,345,757 | A | 8/1982 | Lo Voi | |
| 5,364,338 | A | 11/1994 | Terashima | |
| 5,577,995 | A | 11/1996 | Walker et al. | |
| 5,577,996 | A | 11/1996 | Gardner | |
| 7,387,599 | B1 | 6/2008 | Hsu | |
| 2004/0024336 | A1 | 2/2004 | Lin | |
| 2006/0142677 | A1* | 6/2006 | Perez | 601/120 |
| 2006/0235343 | A1 | 10/2006 | Fitzmaurice | |
| 2007/0129654 | A1 | 6/2007 | Anderson, Jr. | |
| 2008/0004553 | A1 | 1/2008 | Tsai | |
| 2008/0103421 | A1 | 5/2008 | Nicholson | |
| 2008/0200851 | A1* | 8/2008 | Faussett | 601/119 |
| 2009/0131234 | A1 | 5/2009 | Dye | |
| 2013/0090582 | A1* | 4/2013 | Bertram et al. | 601/119 |

* cited by examiner

*Primary Examiner* — Quang D Thanh
(74) *Attorney, Agent, or Firm* — Baker & Hostetler LLP

(57) ABSTRACT

The present invention provides in some embodiments, a portable device for massaging and treating a person's muscles. The device can include an elongate center shaft and a roller section rotatably positioned about the outer surface of the elongate cylindrical center shaft and extending at least a portion of a distance between the first end of the elongate cylindrical center shaft and the second end of the elongate cylindrical center shaft. The device can also include a first and second handle coupled to the elongate center shaft. The first and second handles can be configured to collapse in order to decrease an overall length of the portable roller massager.

18 Claims, 6 Drawing Sheets

PORTABLE ROLLER MASSAGER

FIELD OF THE INVENTION

The present invention generally relates to a therapeutic device. More particularly, the present invention pertains to a portable massager for treating a person's musculature.

BACKGROUND OF THE INVENTION

Massage has long been used to treat tight, stiff, and injured muscles, because benefits, such as prevention and prediction of muscle injuries, improvement of strength, flexibility, and endurance, dispersal of lactic acid, and accelerated recovery, are numerous. Athletes and exercise aficionados have long turned to massage to improve performance and ease aching muscles. Using a licensed massage therapist each time massage would be beneficial, but could easily become prohibitively expensive. Additionally, there are times when immediate treatment is necessary. Therefore, hand held massage devices were developed to address these needs. Hand held massage devices are also often used to treat trigger points. One type of hand held massage device is a wand that can be rolled over a person's muscles to treat the ailments and provide the improvements described above. The massage wand can include a roller or rollers over its outer surface. Unfortunately, these devices can be quite long and are not designed for a user to carry during travel or exercise.

It is therefore desirable to provide a portable roller massager device capable of being made smaller without compromising the efficacy of the device.

SUMMARY OF THE INVENTION

The foregoing needs are met, to a great extent, by the present invention, wherein in some embodiments a roller massager that is capable of overcoming the disadvantages described herein at least to some extent is provided.

In accordance with an embodiment of the present invention, a portable roller massager for exercise, massage, therapy, and rehabilitation can include an elongate cylindrical center shaft having a first end and a second end and having a longitudinal axis extending from the first end to the second end. The device can also include a roller section rotatably positioned about the outer surface of the elongate cylindrical center shaft and extending at least a portion of a distance between the first end of the elongate cylindrical center shaft and the second end of the elongate cylindrical center shaft. Additionally, the device can include a first handle movably positioned at the first end of the elongate cylindrical center shaft, and a second handle movably positioned at the second end of the elongate cylindrical center shaft.

In accordance with yet another aspect of the present invention, the portable roller massager can include a two-piece elongate cylindrical center shaft wherein the two pieces snap together. A track can be positioned within an elongate central lumen defined by the elongate cylindrical center shaft. Additionally, the first handle and the second handle are configured to slidably move along the track in order to position at least one of the first handle and the second handle in one of a storage position within the center lumen or an extended position adjacent to the first end or second end of the elongate cylindrical center shaft. A locking mechanism can be included to lock at least one of the first handle and the second handle in a collapsed position within the elongate central lumen of the elongate cylindrical center shaft. Further, washers positioned at the first end and the second end of the elongate cylindrical center shaft can be configured to hold the roller section on the elongate cylindrical center shaft.

In accordance with another aspect of the present invention, a portable roller massager includes an elongate center shaft having a first end and a second end, having an outer surface defining an elongate central lumen which extends from the first end of the elongate center shaft to the second end of the elongate center shaft, and having a longitudinal axis extending from the first end to the second end. A roller section can have multiple segments. Each segment being rotatably positioned about the outer surface of the elongate center shaft and can extend at least a portion of a distance between the first end of the elongate center shaft and the second end of the elongate center shaft. The massager can also include a first handle having a first position at the first end of the elongate center shaft, configured to slide into a second position within the elongate central lumen of the elongate center shaft, and configured to lock into at least one of the first position and the second position. Additionally, a second handle can have a first position at the second end of the elongate center shaft, configured to slide into a second position within the elongate central lumen of the elongate center shaft, and configured to lock into at least one of the first position and the second position.

In accordance with another embodiment of the invention, a portable roller massager can include an elongate center shaft having a first end and a second end, having an outer surface defining an elongate central lumen which extends from the first end of the elongate center shaft to the second end of the elongate center shaft, and having a longitudinal axis extending from the first end to the second end. A roller section can be rotatably positioned about the outer surface of the elongate center shaft and can extend at least a portion of a distance between the first end of the elongate center shaft and the second end of the elongate center shaft. The massager can also include a track positioned within the central lumen of the elongate center shaft. In addition, a first handle can be slidably positioned on the track having a first position at the first end of the elongate center shaft and configured to slide into a second position within the elongate central lumen of the elongate center shaft. A second handle can also be slidably positioned on the track having a first position at the second end of the elongate center shaft and configured to slide into a second position within the elongate central lumen of the elongate center shaft.

In accordance with another embodiment of the roller massager the roller section can be freely rotatable about the outer surface of the elongate cylindrical center shaft. The roller section can include ridges extending along an outer surface of the roller section in a direction parallel to the longitudinal axis of the elongate cylindrical center shaft, and in some embodiments the ridges can cover the entire outer surface of the roller. The roller section can have a unibody construction or can include multiple segments. If the roller has multiple segments, each segment of the roller section can be freely and independently rotatable about the outer surface of the elongate cylindrical center shaft. The roller section can be formed from at least one of foam, rubber, thermoplastic elastomer, or plastic. The roller can also be substantially rounded about its outer surface.

There has thus been outlined, rather broadly, certain embodiments of the invention in order that the detailed description thereof, herein may be better understood, and in order that the present contribution to the art may be better appreciated. There are, of course, additional embodiments of the invention that will be described below and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of embodiments in addition to those described and of being practiced and carried out in various ways. Also, it is to be understood that the phraseology and terminology employed herein, as well as the abstract, are for the purpose of description and should not be regarded as limiting.

As such, those skilled in the art will appreciate that the conception upon which this disclosure is based may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

DETAILED DESCRIPTION

The present invention provides in some embodiments, a portable device for massaging and treating a person's muscles. The device can include an elongate center shaft and a roller section rotatably positioned about the outer surface of the elongate cylindrical center shaft and extending at least a portion of a distance between the first end of the elongate cylindrical center shaft and the second end of the elongate cylindrical center shaft. The device can also include a first and second handle coupled to the elongate center shaft. The first and second handles can be configured to collapse in order to decrease an overall length of the portable roller massager.

Figure 1:
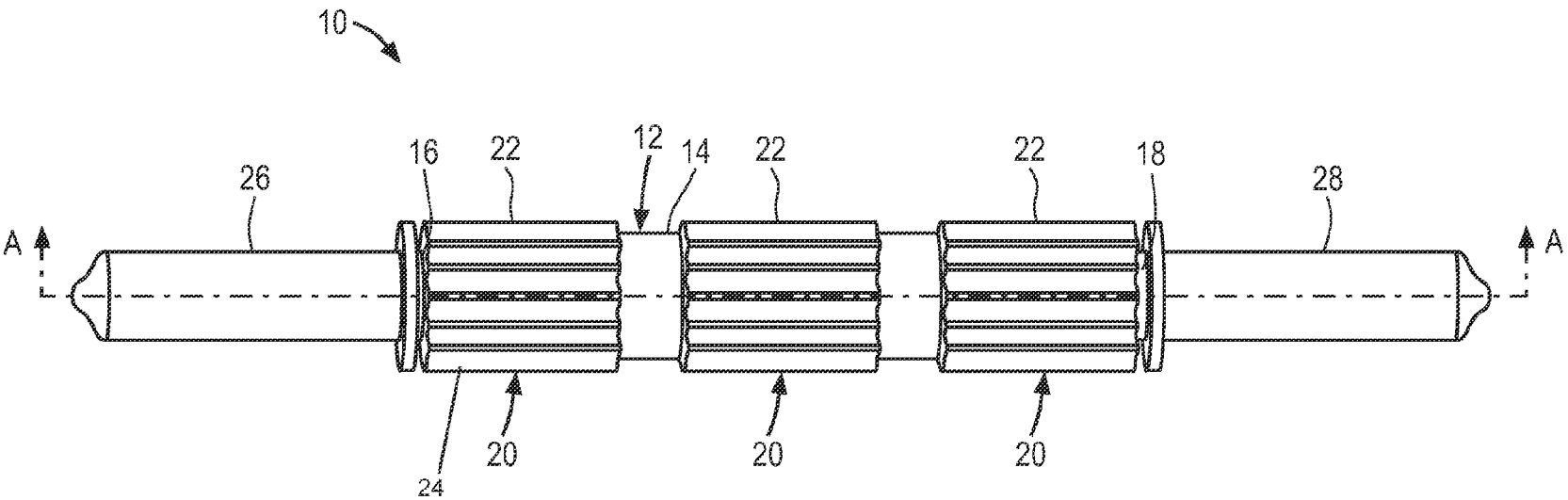
FIG. 1 illustrates a view of a portable roller massager in accordance with an embodiment of the invention.
Figure 2:
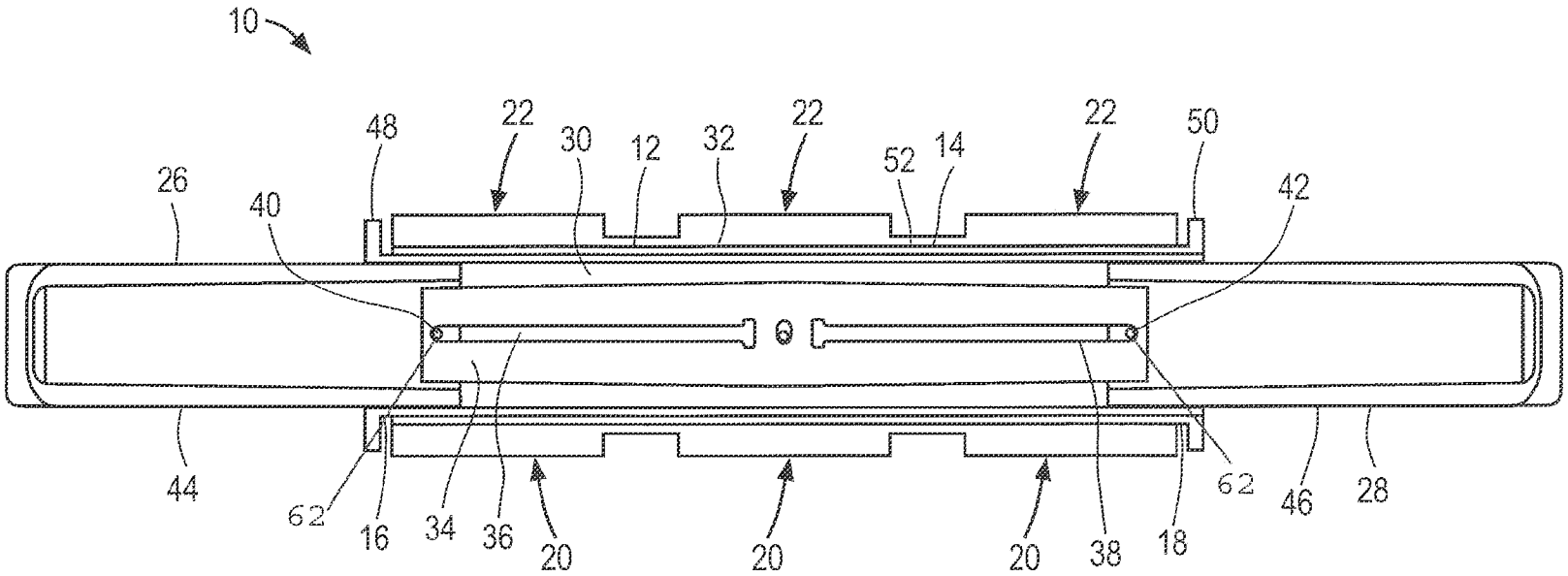
FIG. 2 illustrates a sectional view of the portable roller massager illustrated in FIG. 1 in accordance with an embodiment of the invention.

The invention will now be described with reference to the drawing figures, in which like reference numerals refer to like parts throughout. FIG. 1 illustrates a view of a portable roller massager device 10 and FIG. 2 illustrates a sectional view of the portable roller massager device taken along axis "A" of FIG. 1, in accordance with an embodiment of the present invention. The roller massager device 10 can include an elongate center shaft 12 having an outer surface 14. The elongate center shaft 12 can also have a first end 16 and a second end 18, and a longitudinal axis "A" extending between the first end 16 and the second end 18. Generally, the elongate center shaft 12 can be cylindrical in shape, as illustrated in FIG. 1. The elongate center shaft 12, can be formed from a plastic, metal, wood, or polymer tubing or solid rod, or any other material suitable for forming the elongate center shaft 12.

FIGS. 1 and 2 also illustrate a roller section 20, rotatably positioned around the elongate center shaft 12 of the roller massager device 10. The roller section 20 can extend from the first end 16 of the elongate center shaft 12 to the second end 18 of the elongate center shaft 12. Alternately, the roller section 20 can extend along only a portion of elongate center shaft 12. The roller section 20 can configured to rotate 360 degrees freely about the outer surface 14 of the elongate center shaft 12. However, any suitable range of rotation could also be used. The roller section 20 can take the form of multiple segments of uniform length, as illustrated in the example of FIGS. 1 and 2. Alternately, the roller section 20 can have a unibody construction, segments having different lengths, or any other suitable construction. Generally, an outer surface 22 of the roller section 20 can take a generally curved or cylindrical shape, but any suitable geometry for the outer surface 22 can be used.

The outer surface 22 of the roller section 20 can include a texture. As illustrated in FIG. 1, the roller section 20 includes surface texture in the form of ridges 24 extending along the outer surface 22 of the roller section 20. In the example shown in FIG. 1, the ridges 24 extend lengthwise along the roller section 20, in a direction parallel to the longitudinal axis "A" of the elongate center shaft 12. The texture of the outer surface 22 of the roller section 20 can take many forms, as illustrated herein in FIGS. 4 and 5. These examples are not meant to be limiting, however, and the texture of the outer surface of the roller section can take any form suitable for the purpose of treating a person's musculature. The texture can also be configured to cover all of or just a portion of the outer surface 22 of the roller section 20. Additionally, the roller section 20 can be formed from any suitable material such as foam, rubber, or any durometer plastic, or thermoplastic elastomer.

Also, as illustrated in FIGS. 1 and 2 a first handle 26 and a second handle 28 can be attached to the roller massager 10. The first and/or second handles 26 and 28 can be attached such that either one of the handles can be easily removed or collapsed. Many different forms of attachment can be used such as providing threads on the first and/or second end 16 and 18 of the elongate center shaft and within handles 26 and 28, the handles 26 and 28 can also be held in place frictionally, or by any other means suitable for connecting the handles 26 and 28 to the elongate center shaft. The shape of the first and second handles 26 and 28 can also be configured such that the roller section 20 is prevented from sliding off of the elongate center shaft 12. The handles can be formed from any suitable material such as plastic, foam, or rubber. The handles 26 and 28 may also include a textured outer surface in order to improve the user's grip on the roller massager device 10.

In one example illustrated in FIGS. 1 and 2, the elongate central shaft 12 can include an elongate central lumen 30 extending therethrough. The elongate central lumen 30 is defined by an outer wall 32 of the elongate central shaft 12. A track 34 can also be disposed within the elongate central lumen 30. The track 34 can include a first track slot 36 and a second track slot 38. The handles 26 and 28 can move along the track slot 36, and can include a projection 40, 42 within a lumen 44, 46 of the handles 26 and 28. The projection 40, 42 can be used to prevent the handles 26 and 28 from falling out when they are pulled out from the central lumen 30 of the device 10. The device 10 can also include a locking mechanism 62 to lock at least one of the first handle 26 and the second handle 28 in the extended position and locking mechanism 60 to lock the first handle 26 and the second handle 28 in the collapsed position. The device can also include washers 48, 50 positioned at the first end 14 and the second end 16 of the elongate central shaft 12. The washers 48, 50 can be used to hold the roller section 20 on the elongate center shaft 12. In some embodiments, at least one of these washers 48, 50 can be removed such that the roller section 20 can be exchanged for a different roller section.

Figure 3:
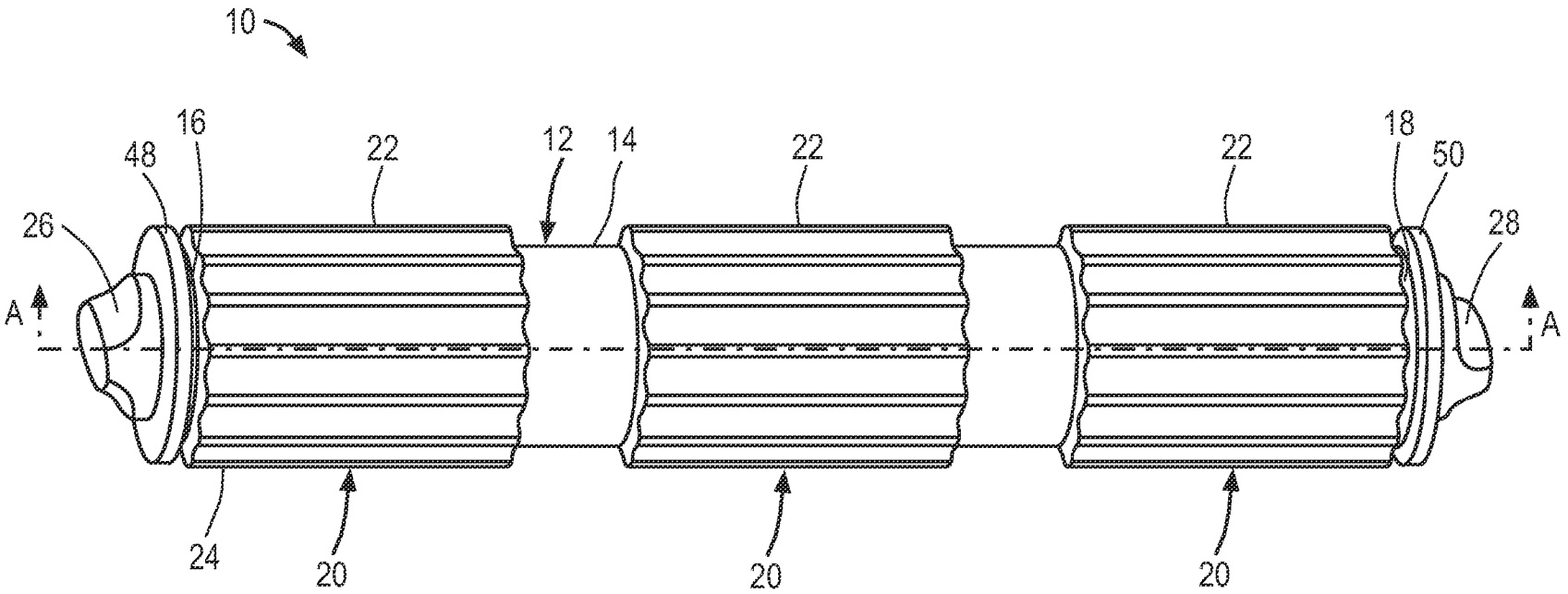
FIG. 3 illustrates another view of a portable roller massager in accordance with an embodiment of the invention.
Figure 4:
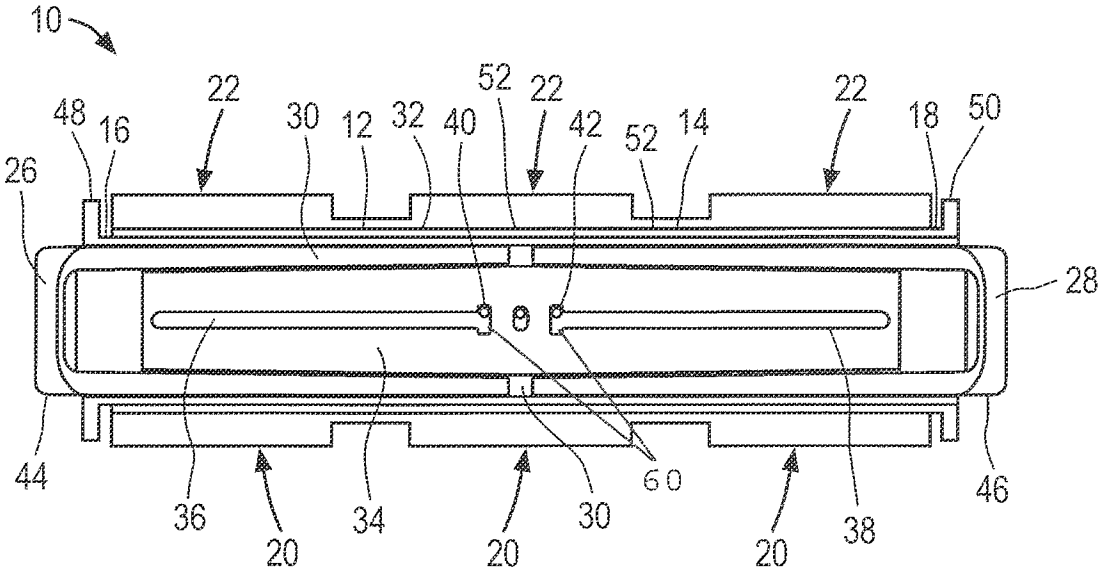
FIG. 4 illustrates a sectional view of the portable roller massager illustrated in FIG. 3 in accordance with an embodiment of the invention.
Figure 5A:
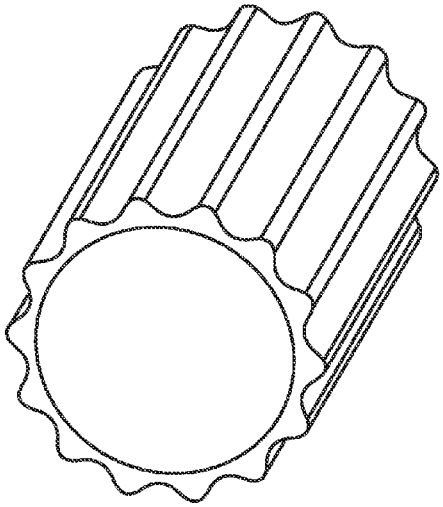
FIGS. 5A-5D illustrate roller sections in accordance with an embodiment of the invention.
Figure 5B:
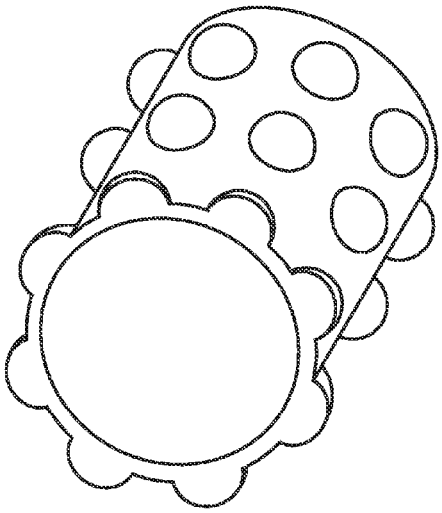
Figure 5C:
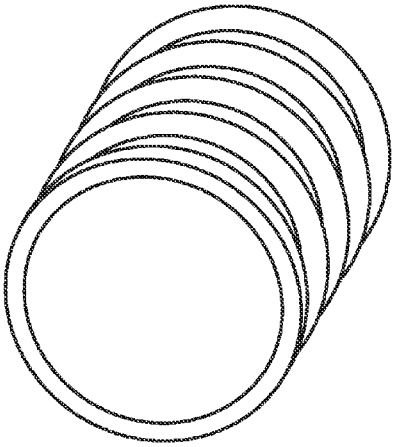
Figure 5D:
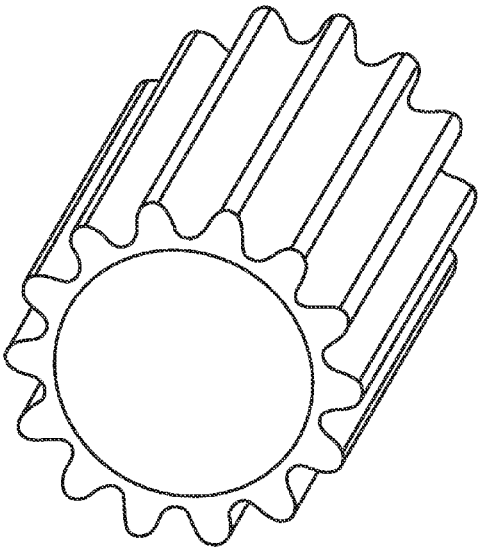
Figure 6A:
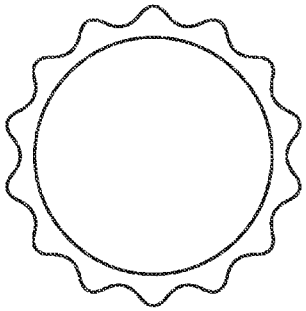
FIGS. 6A-6D illustrate a sectional view of the roller sections illustrated in FIG. 4 in accordance with an embodiment of the invention.
Figure 6B:
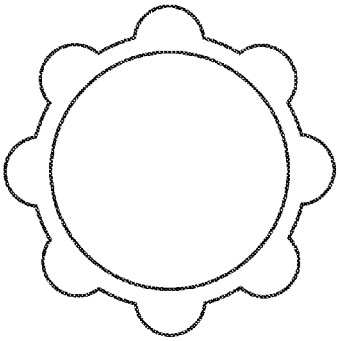
Figure 6C:
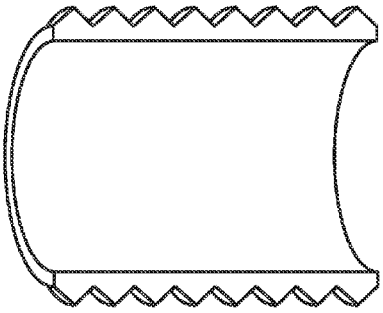
Figure 6D:
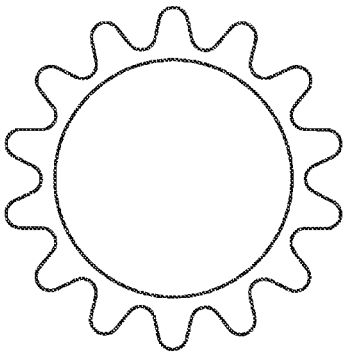

FIG. 3 illustrates the portable roller massager 10 with the handles collapsed into a storage position within the central lumen of the device 10 and FIG. 4 illustrates a sectional view taken along axis "A" of the device 10 illustrated in FIG. 3. As illustrated in FIGS. 3 and 4. The handles 26 and 28 can slide into a space 52 within the central lumen 30 defined by the outer wall 32 of the central shaft 12 on one side and the track 34 on the other. Sliding the handles 26 and 28 into the lumen 32 of the central shaft 12 decreases the overall length of the device along longitudinal axis "A," thus increasing the portability of the device 10. The example illustrated in FIGS. 3 and 4, is just one example of a way to decrease the overall length of the device 10. Any means suitable for decreasing the overall length of the device can be used.

FIGS. 5A-5D illustrate different textures for an outer surface of a roller section in accordance with an embodiment of the invention, and FIGS. 6A-6D show a sectional view of the textured roller sections illustrated in FIGS. 5A-5D. The different surface textures illustrated in these figures are not to be considered limiting, but are simply examples of various surface textures that can be used for the roller section. These textures can also be combined on a single segment of the roller section. Alternately, in a roller section having multiple segments, the segments can have varying surface textures. Additionally, various factors can be changed in order to create a progression for the roller sections. For instance, the depth of the texture on the surface of the roller section can be increased or decreased to create a different degrees of treatment. The material used to form the roller sections can also be changed. For example, the density of the material can be increased or decreased in order to provide different degrees of treatment. The material itself can also be varied for instance a progression could include a soft foam and a progression of different materials ending with a harder plastic. The examples discussed above are merely examples and are not to be considered limiting. The roller sections can be provided in any combination of material and surface texture appropriate for providing the desired treatment.

The many features and advantages of the invention are apparent from the detailed specification, and thus, it is intended by the appended claims to cover all such features and advantages of the invention which fall within the true spirit and scope of the invention. Further, because numerous modifications and variations will readily occur to those skilled in the art, it is not desired to limit the invention to the exact construction and operation illustrated and described, and accordingly, all suitable modifications and equivalents may be resorted to falling within the scope of the invention.

What is claimed is:

1. A portable roller massager for exercise, massage, therapy, and rehabilitation comprising:

an elongate cylindrical center shaft having a first end and a second end and having a longitudinal axis extending from the first end to the second end;

a roller section rotatably positioned about an outer surface of the elongate cylindrical center shaft and extending at least a portion of a distance between the first end of the elongate cylindrical center shaft and the second end of the elongate cylindrical center shaft;

a track positioned within an elongate central lumen defined by the elongate cylindrical center shaft;

a first handle movably positioned at the first end of the elongate cylindrical center shaft; and a second handle movably positioned at the second end of the elongate cylindrical center shaft.

2. The portable roller massager of claim 1 wherein the first handle and the second handle are configured to slidably move along the track in order to position at least one of the first handle and the second handle in one of a storage position within the center lumen or an extended position adjacent to the first end or second end of the elongate cylindrical center shaft.

3. The portable roller massager of claim 1 further comprising a locking mechanism to lock at least one of the first handle and the second handle in a collapsed position within the elongate central lumen of the elongate cylindrical center shaft.

4. The portable roller massager of claim 1 further comprising washers positioned at the first end and the second end of the elongate cylindrical center shaft and configured to hold the roller section on the elongate cylindrical center shaft.

5. The portable roller massager of claim 1, wherein the roller section is freely rotatable about the outer surface of the elongate cylindrical center shaft.

6. The portable roller massager of claim 1, wherein the roller section comprises ridges extending along an outer surface of the roller section in a direction parallel to the longitudinal axis of the elongate cylindrical center shaft.

7. The portable roller massager of claim 1, wherein the roller section comprises at least one of foam, rubber, thermoplastic elastomer, or plastic.

8. A portable roller massager comprising:

an elongate center shaft having a first, end and a second end, having an outer surface defining an elongate central lumen which extends from the first end of the elongate center shaft to the second end of the elongate center shaft, and having a longitudinal axis extending from the first end to the second end;

a roller section having multiple segments, each segment being rotatably positioned about the outer surface of the elongate center shaft and extending at least a portion of a distance between the first end of the elongate center shaft and the second end of the elongate center shaft;

a first handle having a first position at the first end of the elongate center shaft, configured to slide into a second position within the elongate central lumen of the elongate center shaft, and configured to lock into at least one of the first position and the second position; and a second handle having a first position at the second end of the elongate center shaft, configured to slide into a second position within the elongate central lumen of the elongate center shaft, and configured to lock into at least one of the first position and the second position.

9. The portable roller massager of claim 8 further comprising a track positioned within the elongate central lumen of the elongate center shaft.

10. The portable roller massager of claim 9, wherein the first handle and the second handle are configured to slidably move along the track into the first position and the second position.

11. The portable roller massager of claim 8 further comprising washers positioned at the first end and the second end of the elongate center shaft and configured to hold the roller section on the elongate center shaft.

12. The portable roller massager of claim 8, wherein the roller section is freely rotatable about the outer surface of the elongate center shaft.

13. The portable roller massager of claim 8, wherein the roller section comprises ridges extending along an outer surface of the roller section in a direction parallel to the longitudinal axis of the elongate center shaft.

14. A portable roller massager comprising:

an elongate center shaft having a first end and a second end, having an outer surface defining an elongate central lumen which extends from the first end of the elongate center shaft to the second end of the elongate center shall, and having a longitudinal axis extending from the first end to the second end;

a roller section rotatably positioned about the outer surface of the elongate center shaft and extending at least a portion of a distance between the first end of the elongate center shaft and the second end of the elongate center shaft;

a track positioned within the central lumen of the elongate center shaft;

a first handle slidably positioned on the track having a first position at the first end of the elongate center shaft and configured to slide into a second position within the elongate central lumen of the elongate center shaft; and a second handle slidably positioned on the track having a first position at the second end of the elongate center shaft and configured to slide into a second position within the elongate central lumen of the elongate center shaft.

15. The portable roller massager of claim 14 further comprising a locking mechanism to lock at least one of the first handle and the second handle in at least one of the first and the second position.

16. The portable roller massager of claim 14 further comprising washers positioned at the first end and the second end of the elongate center shaft and configured to hold the roller section on the elongate center shaft.

17. The portable roller massager of claim 14, wherein the roller section comprises ridges extending along an outer surface of the roller section in a direction parallel to the longitudinal axis of the elongate center shall.

18. The portable roller massager of claim 14, wherein the roller section comprises one of foam, rubber, or low durometer plastic.

* * * * *